US006574339B1

(12) United States Patent
Kim et al.

(10) Patent No.: US 6,574,339 B1
(45) Date of Patent: Jun. 3, 2003

(54) THREE-DIMENSIONAL SOUND REPRODUCING APPARATUS FOR MULTIPLE LISTENERS AND METHOD THEREOF

(75) Inventors: Doh-hyung Kim, Suwon (KR); Yang-seock Seo, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/175,473

(22) Filed: Oct. 20, 1998

(51) Int. Cl.[7] ..... H04R 5/00; H04R 5/02; H04R 1/10

(52) U.S. Cl. ..... 381/17; 381/310; 381/307; 381/300; 381/74

(58) Field of Search ..... 381/317, 307, 381/300, 303, 17, 74, 310

(56) References Cited

U.S. PATENT DOCUMENTS 4,004,095 A * 1/1977 Cardone ..... 370/498
5,596,644 A * 1/1997 Abel et al. ..... 381/17
5,734,724 A * 3/1998 Kinoshita et al. ..... 370/265
5,841,879 A * 11/1998 Scofield et al. ..... 381/309
5,862,227 A * 1/1999 Orduna-Bustamante et al. . 381/17
6,125,115 A * 9/2000 Smits ..... 370/260
6,173,061 B1 * 1/2001 Norris et al. ..... 381/1

OTHER PUBLICATIONS

Chris Schmandt, "AudioStreamer: Exploiting Simultaneity for Listening", CHI '95 Proceedings Short Papers, Dec. 6, 1995, 4 pages.

"Sound Demo Files, HRTFs", 4 pages, Author, publishers and date unknown.

Product description of HK 695 Audio System, Dell.com, 1999, 1 page.

Bill Gardner et al., "HRTF Measurements of a KEMAR Dummy–Head Microphone", MIT Media Lab, May 18, 1994, 2 pages.

Richard O. Duda, "Modeling Head Related Transfer Functions", 1993 IEEE, pp. 996–1000.

An–Nan Suen et al., "VLSI Implementation of 3–D Sound Generator", 1997 IEEE, Jun. 13, 1997, pp. 679–687.

* cited by examiner

*Primary Examiner*—Forester W. Isen
*Assistant Examiner*—Elizabeth McChesney
(74) *Attorney, Agent, or Firm*—Burns, Doane, Swecker & Mathis, LLP

(57) ABSTRACT

A 3D sound reproducing apparatus for multiple listeners includes an inverse filter module for filtering an input sound signal such that each of the listeners can have the same virtual sound source, time multiplexing module for sequentially selecting one of the sound signals filtered by the inverse filter module at a predetermined interval, and a plurality of speakers for outputting the sound signal selected by the time multiplexing means as sound. Thus, the 3D sound reproducing apparatus for multiple listeners can concurrently present the same 3D sound effect to multiple listeners.

4 Claims, 6 Drawing Sheets

THREE-DIMENSIONAL SOUND REPRODUCING APPARATUS FOR MULTIPLE LISTENERS AND METHOD THEREOF

BACKGROUND OF THE INVENTION

1. Field of the Invention

The present invention relates to a three-dimensional (3D) sound reproducing apparatus, and more particularly, to a 3D sound reproducing apparatus for multiple listeners which concurrently presents the same 3D sound to multiple listeners, and a method thereof.

2. Description of the Related Art

In the audio industry, there has been efforts to reproduce sound with a full sense of presence such that an audio case is formed at a one dimensional point or on a two dimensional plane. That is, a mono system at the initial development stage, a stereo system, and recently a Dolby surround sound system are all for reproduction of sound with a sense of presence. However, as the multimedia industry develops, the aim of technologies concerning recording and reproducing aural information, i.e., a sound signal, as well as visual information, changes from a faithful reproduction with a sense of presence to a reproduction with a 3D sound space in which an audio case can be located at an arbitrary position.

Most audio apparatuses available today reproduce a stereo sound signal rather than a mono sound signal. When a stereo sound signal is reproduced, the range of a sense of presence felt through reproduced signals is limited by the installation positions of speakers. Accordingly, to improve the range of a sense of presence, studies for improving reproduction capability of a speaker and generating a virtual signal using signal processing have been conducted.

A typical system from the result of the above studies is the Dolby surround stereo system of a surround reproduction method using a set of five speakers. In this system, a virtual signal output to rear speakers is separately processed. The virtual signal is generated by delaying the signal according to spacial movement of the signal and transmitting a signal whose amplitude is reduced to the rear speakers. Currently, most home video cassette recorders and laser disk players employ such a technology called Dolby Pro Logic Surround System. Due to an apparatus employing the above technology, the quality of sound felt in the theater can be reproduced at home.

As is stated above, although sound more faithful to a sense of presence can be obtained by increasing the number of channels, as many speakers as the number of channels are required. Accordingly, costs and installation space problems occur.

These problems can be improved by applying the result of a study on how humans hear and feel sound exiting in a 3D space. Particularly, among the studies on sound recognition by humans, studies concerning both ears greatly affect recognition of a sound source in a 3D space.

The above studies on both ears concern a mutual effect of input signals input to both ears, i.e., an interaural intensity difference of the amplitude of a signal felt by the right ear and the left ear, or a difference of phase of sound input to the right and left ears generated due to an interaural time difference in transmitting sound. According to the result of research on both ears, the property of recognizing a sound source existing at one point in a space by humans has been modeled. Such recognition property is referred to as a head related transfer function (hereinafter called "HRTF").

The HRTF is a filter coefficient for modeling routes from a sound source to the eardrum and characteristically has a value varying according to the relative position between a sound source and the head. The HRTF is represented as an impulse response or a transfer function at the middle ear with respect to a feature in the case in which the signal is transmitted to both ears when a sound source exists at one point in a space. By applying the HRTF, a process of transferring a position where sound exists to another arbitrary position in a 3D space can be possible.

Meanwhile, many studies have been made concerning how the hearing sense of humans can recognize a 3D sound space. A virtual sound source has recently been suggested and an actual application field is being searched for.

In general, one can best hear a stereo sound at a position that is at the apex of a regular triangle having a straight line connecting two speakers as the base thereof. However, since it is not possible to limit the position of the audience at that position, spatial problem occurs. Also, it is very difficult to adjust the balance of sound according to the position of the audience.

Aiwa, a Japanese company, has solved this problem by including a "uni-oriented" speaker, capable of generating a hard sound toward a listener, in a conventional speaker unit. The most characteristic of the speaker above is that the audience at any position in front of the speaker unit can enjoy a balanced stereo sound. In an ordinary speaker system, as a listener moves to the left with respect to the speaker unit, sound generated by the right speaker decreases. However, since the uni-oriented speaker included in the speaker unit is angled 45° inwardly, the right speaker generates a hard sound to the left and a weak sound to the right. Reversely, the uni-oriented speaker of the left speaker unit generates a weak sound to the left and a hard sound to the right. Consequently, the sound generated by both the left and right speakers are balanced when the listener is positioned to the left or right.

A speaker system developed in 1993 by Japan Victor Company, another Japanese company, provides a virtual reality sound by which sound from the rear side where no speaker actually is present can be heard with only two speakers disposed at the front side. The above speaker utilizes aural hallucination by humans. Humans unconsciously search for the direction of sound using both ears. The speed of sound transferred is 340 m/sec and the distance between the ears is about 20 cm, so that the difference in time for transferring sound to both ears is 1/500 sec at its maximum. The difference in the a level of sound to both ears is also a major factor in recognizing the direction of sound. Humans recognize a source of sound by using information obtained from the two differences and the eyes. Thus, if the time for transferring sound to both ears can be controlled, sound generated from only two speakers can cover the whole room so that listener can feel as if he/she were sitting in a theater.

However, all 3D sound-related technologies having been developed so far targets a single listener. That is, the current audio reproduction system provides an effect of stereo sound when a single listener is positioned at the apex of a regular triangle using a straight line between two speakers as a base. Thus, in the case of multiple listeners, the same and concurrent stereo effect is not possible.

Such a problem becomes serious in a case of a home theater system. As shown in FIG. 1, when all family members are seated around a sound source, a conventional home theater system cannot provide all family members with good stereo sound.

Recently, there are suggestions to provide a sense of presence and space using more speakers by providing a Dolby Pro Logic system instead of the two channel reproduction. However, in the above system, a plurality of listeners should be positioned at the center of a circle connecting each speaker to enjoy a complete 3D effect. Further, in order to reproduce multi-channel audio, corresponding multiple speakers and an amplifier to drive each speaker should be provided. Thus, problems of costs and installation space occur.

SUMMARY OF THE INVENTION

To solve the above problems, it is an objective of the present invention to provide a 3D sound reproducing apparatus which provides with multiple listeners, regardless of their positions, the same 3D sound effect at the same time, and a method thereof.

Accordingly, to achieve the above objective, there is provided a 3D sound reproducing apparatus for multiple listeners which includes an inverse filter module for filtering an input sound signal such that each of the listeners can have the same virtual sound source, time multiplexing module for sequentially selecting one of the sound signals filtered by said inverse filter module at a predetermined interval, and a plurality of speakers for outputting the sound signal selected by said time multiplexing means as sound.

According to another aspect of the present invention, there is provided a method for reproducing an input sound signal through a fixed number of two or more speakers to provide the same 3D sound effect to multiple listeners, which includes the steps of obtaining a speaker transfer function which models a route between said speakers and an ear of each of the listeners, (b) obtaining filter values by multiplying the inverse matrix of the speaker transfer functions by a virtual sound source transfer function which models a route between a virtual sound source and an ear of a listener, (c) sequentially selecting one of the filter values in order at a predetermined interval; and (d) convolution-processing an input sound signal with the selected filter value and outputting the result of the convolution process to the speaker.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
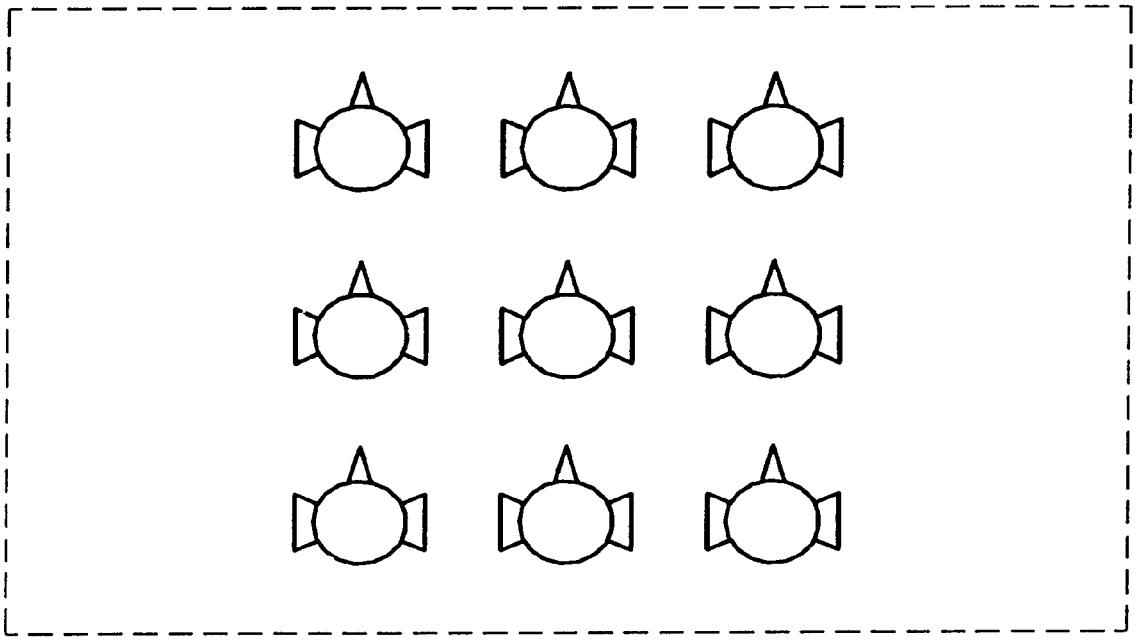
FIG. 1 is a view illustrating a case in which multiple listeners are positioned in a conventional stereo reproducing system.
Figure 2:
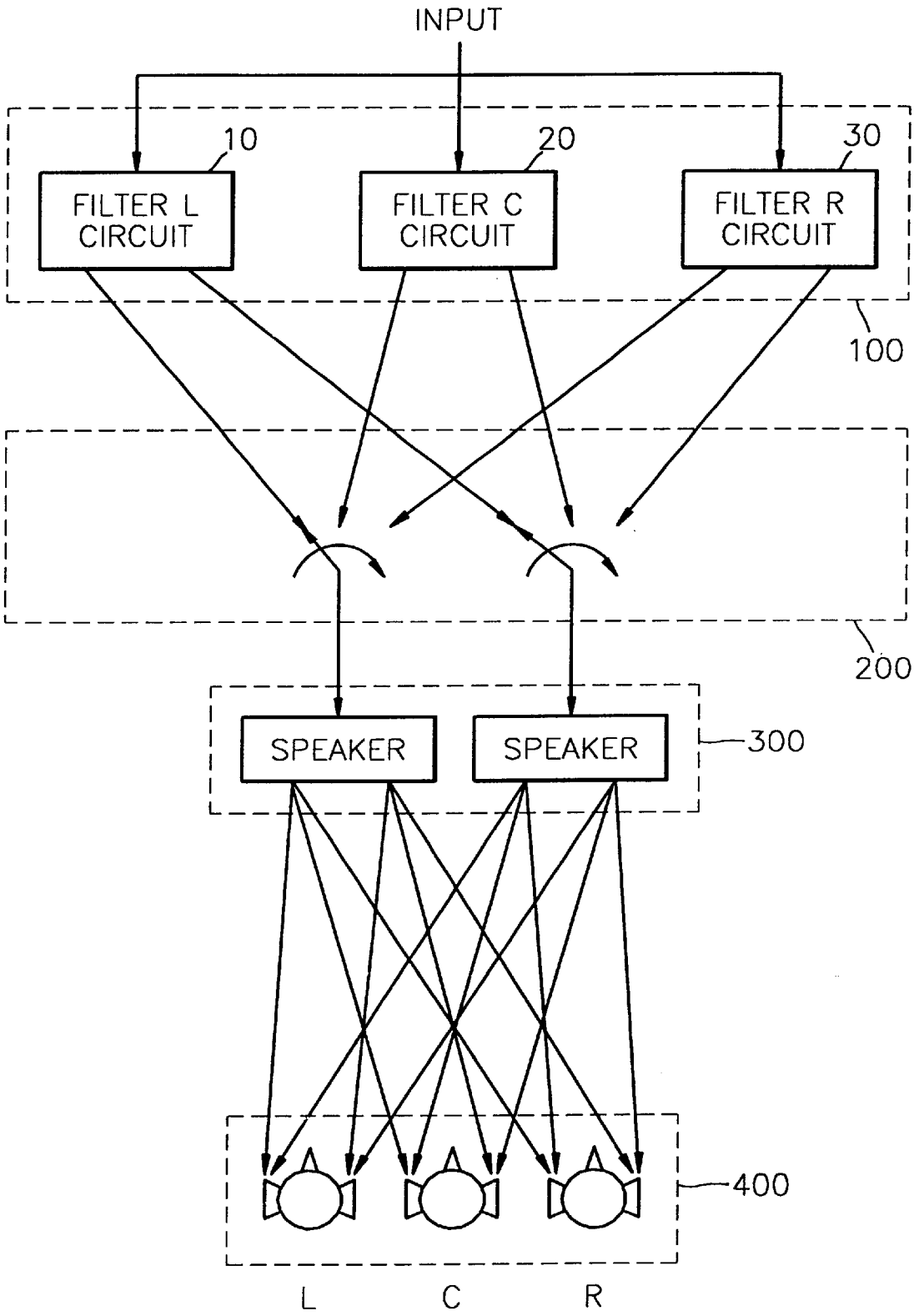
FIG. 2 is a block diagram showing the structure of a 3D sound reproducing apparatus for multiple listeners according to the present invention.

According to FIG. 2, a 3D sound reproducing apparatus for multiple listeners according to the present invention includes an inverse filter module 100, a time multiplexing means 200, and a plurality of speakers 300.

The inverse filter module 100 filters an input sound signal in order to have the same virtual sound source with respect to each of a plurality of listeners 400 and includes a plurality of inverse filter portions 10, 20 and 30. The time multiplexing means 200 selects one sound signal of the sound signals filtered by the inverse filter module 100 in order according to a predetermined period. The speakers 300 output the sound signal selected by the time multiplexing means 200 as sound.

In a method according to the present invention, a HRTF measuring model according to each position of multiple listeners is required. This is because, compared to a standard position of a listener at the center of two speakers, the positions of multiple listeners are expected to be considerably varied and away from the standard position. Thus, more accurate HRTF model for speakers and each listener is required.

A HRTF used in the present invention is described as follows.

HRTF is a filter coefficient obtained by modeling a transfer route from a sound source to the ear drum of a human. Also, it means a transfer function on a frequency plane showing a transfer of sound from a sound source to the ear canal of a human ear in a free field and further the degree of frequency distortion due to the human's head, auricle and body.

In view of the structure of an ear, the frequency spectrum of a signal is distorted due to the irregular shape of an auricle before the signal arrives at an ear canal. Since the distortion varies according to the direction or distance of sound, a change of such a frequency component functions as a major factor in recognizing the direction of sound by a human. It is the HRTF that shows the degree of frequency distortion.

Consequently, the HRTF is dominated by the position of a sound source and the HRTF of the left ear and that of the right ear differ from each other with respect to the same position of the sound source. Also, since the shapes of the auricle and face of each human differ from one another, the HRTF differs according to each person.

A 3D sound can be reproduced by applying the HRTF. That is, when the HRTF at a particular position and an input audio signal are convolution-processed, sound seems to be generated at a particular position.

$$y[n]=h[n]*x[n]=IFFT\{H[k]\cdot X[k]\} \quad \text{[Equation 1]}$$

In general, convolution in a time area of two signals h[n] and x[n] is the same as IFFT (inverse fast fourier transform) of multiplication in a frequency area of two signals H[k] and X[k] which are FFT (fast fourier transform)-processed, as shown in Equation 1. The given HRTF is FFT-processed in advance. Commonly, the method above is chosen since the process speed of multiplication in a frequency area is faster than convolution calculation in a time area.

An HRTF corresponding to the initial position information of a speaker is obtained and then another HRTF corresponding to the position of a virtual sound source is obtained and a matrix calculation is performed. The matrix calculation provides a correlation between the position of a speaker and that of a virtual sound source. Thus, since speakers at any position can obtain a mutual relation through the matrix calculation, the quality of reproduced sound has no relationship with the position of a speaker.

First, a 3D sound reproducing method for a case of a single listener will be described.

Figure 3:
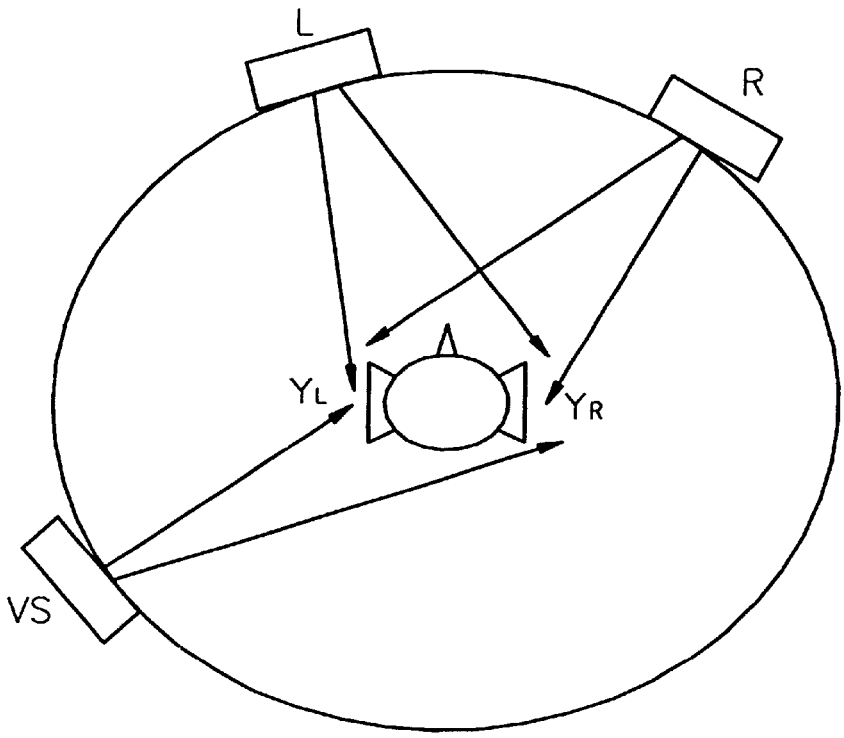
FIG. 3 is a view showing an example of a relationship between a sound source on a virtual space and two speakers included in a two-channel reproduction system.

As shown in FIG. 3, assuming that the position of a listener is at the center of a circle connecting two speakers, as data needed to reproduce 3D sound, a total of six HRTFs including four HRTFs from each speaker to both ears of the listener and two HRTFs from a virtual sound source to both ears of the listener are needed. In FIG. 3, L and R represent the position of the respective left and right speakers, and vs indicates a virtual position from where the listener wishes to listen.

Although all sound is actually generated from the two speakers, the listener feels as if the sound is being generated from a particular position in a 3D space. Such is possible by removing sound itself which is generated by the two speakers and convolution-processing the input signal and the HRTF for a particular position from where the listener wishes to listen.

An inverse filter is used in order to remove HRTF between the two speakers and both ears. Here, the signal output from the left speaker should not be transferred to the left ear and the signal output from the right speaker should not be transferred to the right ear. This is a cross-talk cancellation method. After the sound generated by the two speakers is removed, the HRTF for a direction the listener wishes to listen is convolution-processed along with the input signal. Thus, sound is felt by the listener as if it were being generated from a particular position, not from the speaker.

Figure 4:
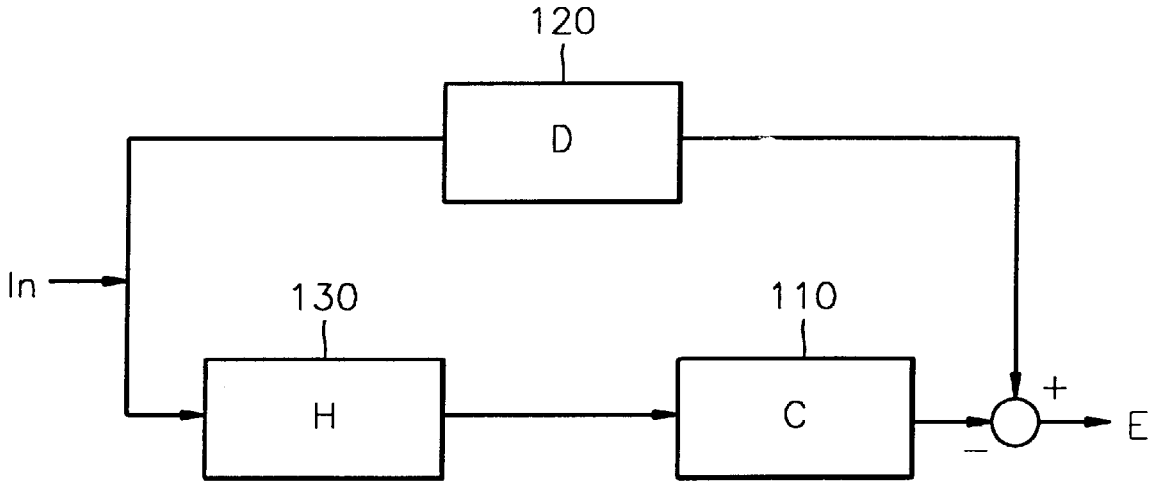
FIG. 4 is a block diagram showing a speaker position compensation relationship for generating a virtual sound source in the two-channel reproduction system which is expressed by a transfer function concept.
Figure 5:
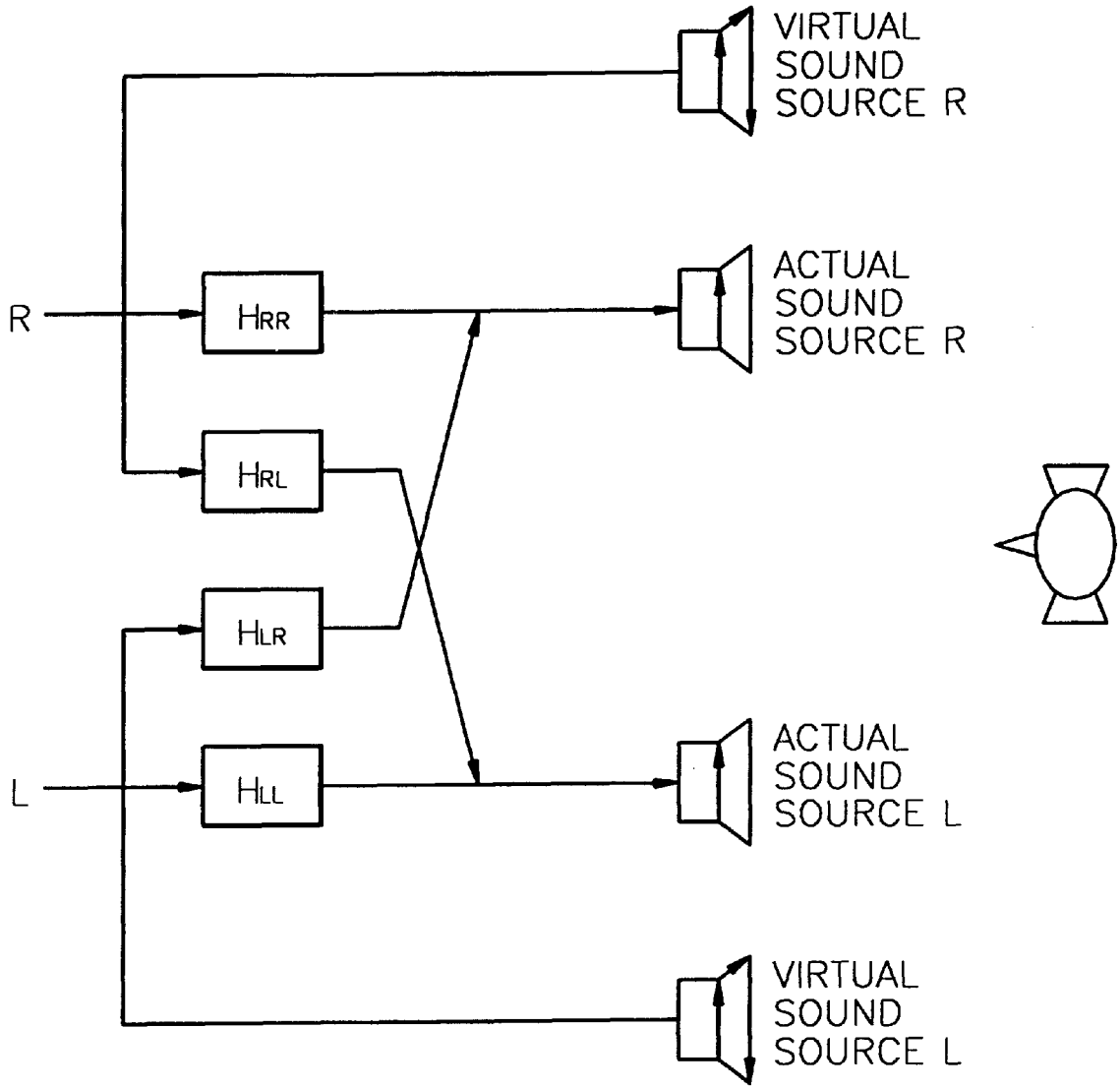
FIG. 5 is a view showing an example of a relationship between a virtual sound source and an actual sound source inverse-filtered in the two channel reproduction system.

Referring to FIG. 4, a block C 110 is a filter matrix for modeling a route of sound transferred from two speakers to both ears of a human and a block D 120 is a filter matrix for modeling a route of sound transferred from a virtual sound source that a user wishes to listen to both ears. A block H 130 is a matrix of an inverse filer for compensating for the relation between a virtual sound source and two installed speakers, in which a convolution process is performed to the input signal before being output to the speaker. FIG. 5 shows a conception of the above relationship.

Figure 6:
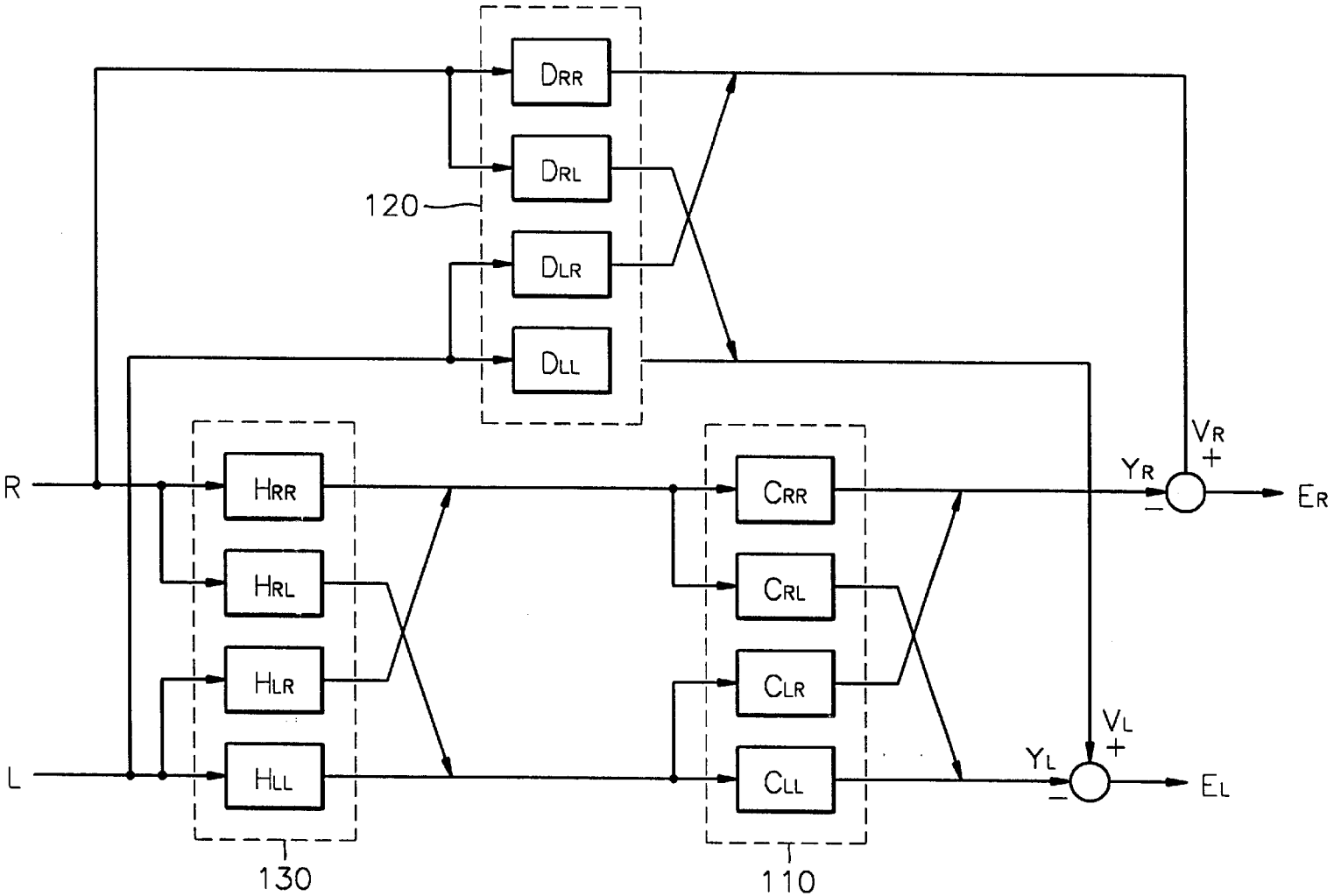
FIG. 6 is a block diagram showing the structure of the speaker position compensation system of FIG. 4 which is structured in detail using a filter matrix.

A calculation method of the inverse filter H is represented as shown in FIG. 6. That is, when two input signals are L and R, respectively, final output signals $Y_L$ and $Y_R$ transferred to both ears from the speakers can be represented as follows.

$$\begin{bmatrix} Y_L \\ Y_R \end{bmatrix} = \begin{bmatrix} C_{LL} & C_{RL} \\ C_{LR} & C_{RR} \end{bmatrix} \cdot \begin{bmatrix} H_{LL} & H_{RL} \\ H_{LR} & H_{RR} \end{bmatrix} \cdot \begin{bmatrix} L \\ R \end{bmatrix} \quad \text{[Equation 2]}$$

Also, given that virtual output values at the position from where the listener wishes to listen are $V_L$ and $V_R$, the above can be represented as follows.

$$\begin{bmatrix} V_L \\ V_R \end{bmatrix} = \begin{bmatrix} D_{LL} & D_{RL} \\ D_{LR} & D_{RR} \end{bmatrix} \cdot \begin{bmatrix} L \\ R \end{bmatrix} \quad \text{[Equation 3]}$$

As a result, in an ideal state, the Equation 2 and the Equation 3 should be equal. Actually, it is better if the error between two equations is less. Assuming that both equations are the same, an inverse filter H matrix is obtained as follows:

$$\begin{bmatrix} H_{LL} & H_{RL} \\ H_{LR} & H_{RR} \end{bmatrix} = \begin{bmatrix} C_{LL} & C_{RL} \\ C_{LR} & C_{RR} \end{bmatrix}^{-1} \cdot \begin{bmatrix} D_{LL} & D_{RL} \\ D_{LR} & D_{RR} \end{bmatrix} \quad \text{[Equation 4]}$$

$$= \frac{1}{C_{LL}C_{RR} - C_{LR}C_{RL}} \begin{bmatrix} C_{RR} & -C_{RL} \\ -C_{LR} & C_{LL} \end{bmatrix}^{1} \cdot \begin{bmatrix} D_{LL} & D_{RL} \\ D_{LR} & D_{RR} \end{bmatrix}$$

The following is a description of a reproduction method for multiple listeners.

Figure 7:
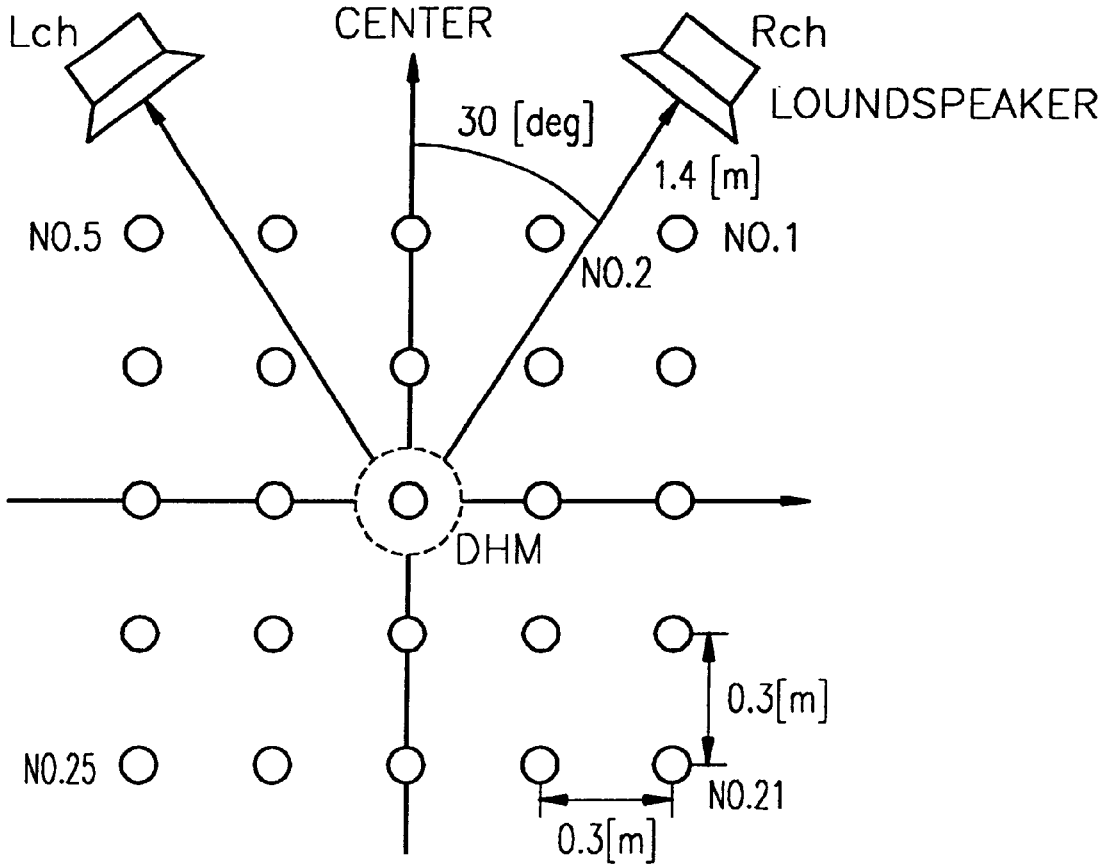
FIG. 7 is a view showing the arrangement of speakers and a dummy head in an experiment for accurately modeling a HRTF at the positions of multiple listeners.

In a reproduction method for a case in which there are multiple listeners, an accurate HRTF model corresponding to the position of each listener should be present. Since a typical HRTF such as a Kemar model provided by MIT models a transfer function when a listener is located at the center, it cannot be applied to the present invention as it is. Thus, to measure the HRTF according to the position of a listener, experimental equipment are arrayed as shown in FIG. 7. Here, the distance between each listener is set to be 30 cm and the positions of two speakers are angled 30° to the left and right which are the standard stereo reproduction position. By using the HRTF per position of a listener obtained as above, each inverse filter is calculated again so that the inverse filter module 100 including a plurality of inverse filter portions 10, 20, and 30 corresponding to each listener is obtained.

A time multiplexing method that is the core portion of the present invention will be described.

The inverse filter portions separately processed for each listener are alternatively selected at predetermined time intervals and a sound signal processed by the selected inverse filter portion is reproduced through two speakers. The above is possible since a listener's ears feel a continuous sound which continues to proceed at a certain interval, due to an after imaging phenomenon, although actual cuts forming the sound are not continuous. That is although the result of each filter processing is independent of each other from the position of each listener, when the results are alternatively output to the speaker at a predetermined time interval, each listener can feel as if he/she hears continuous sound at his/her position.

Here, the most important thing is a reproduction time interval for the respective positions. If a reproduction time for a position is set to be too long, other listeners at another position cannot hear the sound. Also, of the reproduction time is too short, the listener does not have sufficient time to hear a complete sound.

The operation of the present invention is as follows.

In order to reproduce a sound signal, which is input to provide the same effect of 3D sound to multiple listeners, through two speakers, speaker transfer functions which model a route between both ears of a listener from the two speakers for each listener are obtained. Here, the position of the listener can be positioned within a particular range, not being limited to the center position.

Next, filter values are obtained by multiplying a virtual sound source transfer function which models a route between a virtual sound source and an ear of the listener by an inverse matrix of the speaker transfer functions. The input sound signal is convolution-processed by one of the filter values.

One of the filter values is continuously selected and output to the speaker in order at a predetermined interval. Since the time interval of a minimum 20 ms is needed for humans to recognize sound, the reproduction interval per position of a listener should be over 20 ms at the least in the present invention. Also, if there is a large number of listeners, since it takes too much time to process signals for all listeners, the time multiplexing method according to the present invention has a limit in the number of listeners.

In a preferred embodiment of the present invention, the interval of the time multiplexing is structured to be capable of being variably adjusted according to the total number of listeners.

Also, the number of speakers is limited to two in the above description, however, the present invention can be applied to the more speakers. Thus, it is noted that the present invention is not limited to the preferred embodiment described above, and it is apparent that variations and modifications by those skilled in the art can be effected within the spirit and scope of the present invention defined in the appended claims.

As described above, according to the present invention, with only two speakers, 3D sound can be enjoyed and the same effect of 3D sound can be concurrently provided to multiple listeners.

In particular, when a home audio/video theater system is enjoyed at home, all family members freely disposed in front of the speakers can concurrently hear the same 3D sound and enjoy lifelike sound.

What is claimed is:

1. A 3D sound reproducing apparatus for multiple listeners comprising:

an inverse filter module for filtering an input sound signal to produce a plurality of filtered sound signals such that each of a plurality of listener positions can have the same virtual sound source;

time multiplexing module for sequentially selecting one of the sound signals filtered by said inverse filter module at a predetermined interval; and a plurality of speakers for outputting the sound signal selected by said time multiplexing module as sound.

2. The apparatus as claimed in claim 1, wherein said inverse filter module comprises as many inverse filter portions as the number of listener positions, each of said inverse filter portions having a filter property that is a value obtained by multiplying an inverse matrix $C^{-1}$ of a speaker transfer function C that models a route between said speakers and an ear of a listener in a listener position corresponding to the inverse filter portion by a virtual sound source transfer function D which models a route between a virtual sound source and the ear of said listener.

3. A method for reproducing an input sound signal through a fixed number of two or more speakers to provide the same 3D sound effect to multiple listeners, said method comprising the steps of:

(a) obtaining a speaker transfer function which models a route between said speakers and an ear of each of the listeners in the listener positions, (b) obtaining filter values by multiplying the inverse matrix of the speaker transfer functions by a virtual sound source transfer function which models a route between a virtual sound source and an ear of a listener at one of said listener positions;

(c) sequentially selecting one of the filter values in order at a predetermined interval; and (d) convolution-processing an input sound signal with the selected filter value and outputting the result of the convolution process to the speaker.

4. The method as claimed in claim 3, wherein said predetermined interval in said step (c) is variable in proportion to the number of listener positions.

* * * * *